US010565879B2

(12) United States Patent
Larcher et al.

(10) Patent No.: US 10,565,879 B2
(45) Date of Patent: Feb. 18, 2020

(54) SYSTEM AND METHOD FOR IDENTIFYING AN OCCUPANCY STATUS OF PARKING FACILITIES

(71) Applicant: Robert Bosch GmbH, Stuttgart (DE)

(72) Inventors: Nils Larcher, Tuebingen (DE); Martin Werner, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/544,311

(22) PCT Filed: Jan. 27, 2016

(86) PCT No.: PCT/EP2016/051663
§ 371 (c)(1),
(2) Date: Jul. 18, 2017

(87) PCT Pub. No.: WO2016/131624
PCT Pub. Date: Aug. 25, 2016

(65) Prior Publication Data

US 2018/0268694 A1 Sep. 20, 2018

(30) Foreign Application Priority Data

Feb. 17, 2015 (DE) ..... 10 2015 202 788

(51) Int. Cl.
*G08G 1/14* (2006.01)
*G08G 1/04* (2006.01)
*G08G 1/042* (2006.01)

(52) U.S. Cl.
CPC ..... *G08G 1/147* (2013.01); *G08G 1/04* (2013.01); *G08G 1/042* (2013.01)

(58) Field of Classification Search
CPC ..... G08G 1/147; G08G 1/04; G08G 1/042; G08G 1/168; G08G 1/141; B60Q 9/002;
(Continued)

(56) References Cited

U.S. PATENT DOCUMENTS 4,346,293 A * 8/1982 Fetzer ..... G01C 3/24 250/221
8,050,963 B2 * 11/2011 Burdick ..... G06Q 30/02 340/932.2
(Continued)

FOREIGN PATENT DOCUMENTS

DE 102010013878 A1 8/2011
EP 0020879 A1 1/1981
(Continued)

OTHER PUBLICATIONS

International Search Report dated Apr. 21, 2016, of the corresponding International Application PCT/EP2016/051663 filed Jan. 27, 2016.

*Primary Examiner* — Anh V La
(74) *Attorney, Agent, or Firm* — Norton Rose Fulbright US LLP; Gerard A. Messina

(57) ABSTRACT

A system for recognizing an occupancy status of, in particular unmarked, parking facilities is provided, which system includes: a) a plurality of occupancy sensors that are disposed, at a specific distance from one another, on or above an area to be detected; b) a central monitoring unit on which a virtual image of the area to be detected is stored and which is embodied to communicate with the occupancy sensors and to receive sensor data or information regarding the occupancy status at the location or in the vicinity of the respective sensor, the positions of the individual occupancy sensors being known to the central monitoring unit, and the central monitoring unit being embodied to create a virtual image of the occupancy status of the area to be detected and to recognize vacant and occupied sub-areas as a function of the sensor data.

8 Claims, 2 Drawing Sheets

(58) Field of Classification Search
CPC ..... B60Q 2900/30; G06K 9/00812; G06K 9/00771; G06K 9/00785; G06K 9/3241; G06K 9/2054; G06K 2209/23; G06K 9/6256
USPC ..... 340/932.2, 425.5, 686.1, 933, 943, 942, 340/937, 938
See application file for complete search history.

(56) References Cited

U.S. PATENT DOCUMENTS

| | | | | |
|---|---|---|---|---|
| 8,692,688 | B1 | 4/2014 | Tuxen | |
| 2010/0123602 | A1* | 5/2010 | Schmid | G07B 15/02 340/932.2 |
| 2013/0099943 | A1* | 4/2013 | Subramanya | G01S 7/2926 340/933 |
| 2015/0124093 | A1* | 5/2015 | Wang | G06K 9/00812 348/148 |
| 2015/0222859 | A1* | 8/2015 | Schweid | G06K 9/00624 348/148 |

FOREIGN PATENT DOCUMENTS

| | | | |
|---|---|---|---|
| EP | 1628278 | A1 | 2/2006 |
| EP | 1816623 | A1 | 8/2007 |
| EP | 2082386 | A1 | 7/2009 |
| WO | 2009154787 | A2 | 12/2009 |

* cited by examiner

SYSTEM AND METHOD FOR IDENTIFYING AN OCCUPANCY STATUS OF PARKING FACILITIES

BACKGROUND INFORMATION

Determining the capacity utilization of parking garages and paid parking facilities is very important for their operators and in terms of traffic control in cities. Sensors that transmit the status of the parking facility to a monitoring location are therefore used in order to monitor parking facilities. The status normally is detected either via passive sensors or by way of emitting sensors, or via a combination of these concepts. With conventional systems, this detection functions only with delineated parking spaces having a defined number of vehicles (normally one vehicle per parking space).

SUMMARY

An object of the invention is to recognize, independently of predetermined parking markings, whether space exists for a further vehicle on an area such as a parking bay at the curb or in an open field.

For this purpose, a virtual image of the area of an unmarked parking facility is created in a central monitoring unit that receives information from parking facility sensors.

The system according to the present invention for recognizing the occupancy of unmarked parking facilities is made up of the following components:

sensors that are placed, at a specific distance d from one another, on the area to be detected.

A central monitoring unit is embodied to communicate with the sensors and to evaluate the data conveyed from the sensors. The position of the individual sensors is known to the central monitoring unit, and a virtual image of the monitored areas can thereby be created.

According to the present invention, a system for recognizing an occupancy status of, in particular unmarked, parking facilities is provided, which system encompasses:

a) a plurality of occupancy sensors that are disposed, at a specific distance d from one another, on or above an area to be detected;

b) a central monitoring unit on which a virtual image of the area to be detected is stored, and which is embodied to communicate with the occupancy sensors and to receive sensor data or information regarding the occupancy status at the location or in the vicinity of the respective sensor, the positions of the individual occupancy sensors being known to the central monitoring unit, and the central monitoring unit being embodied to create a virtual image of the occupancy status of the area to be detected and to recognize vacant and occupied sub-areas as a function of the sensor data.

The occupancy sensors can be embodied as passive sensors, for example as magnetic sensors or pressure sensors or inertial sensors; or as emitting sensors, in particular as ultrasonic sensors or as radar sensors or as optical sensors. It is likewise conceivable for the occupancy sensors to encompass active and passive sensor components.

The occupancy sensors are preferably recessed into the ground of the area to be detected. Alternatively, the sensors are disposed above the area to be detected, for example as ceiling sensors in a parking garage.

The distance d between two adjacent occupancy sensors is preferably selected as a function of the type of sensor, the distance d preferably being selected in such a way that a vehicle having a minimum length L_min can just be recognized by the system.

The minimum length L_min can be selected as a function of the nature of the area to be detected.

The invention furthermore relates to a method for recognizing an occupancy status of, in particular unmarked, parking facilities, which method encompasses the steps of:

a) detecting a current occupancy status of each occupancy sensor;

b) dividing the area to be detected into vacant and occupied sub-areas as a function of the occupancy statuses of the sensors.

According to a further aspect of the invention a system for managing a parking area is provided, which system encompasses a system for recognizing an occupancy status of the parking area which is embodied as described above, and furthermore encompasses a management unit that is embodied to assign a vacant sub-area to an arriving vehicle as a parking space, the vacant sub-area being assigned in particular as a function of a vehicle length (L).

The system according to the present invention produces, inter alia, the advantages below. Vacant areas can be recognized with no need to mark individual parking spaces. This results in:

better area management, for example because short parking spaces, for which other vehicles are too large, can be marked as vacant for smaller vehicles;

decreasing the time spent looking for parking spaces, and thus less traffic volume;

allows collection of data on parking facility utilization;

an expanded fee model as a function of vehicle length is enabled; for example, a higher fee can be charged for larger/longer vehicles.

The available area can be better utilized so that, for example, smaller spaces are assigned to small vehicles. The profitability of a parking facility can thereby be enhanced, for example because two small vehicles rather than one larger one can park in a given area, which in turn can result in higher revenues for the operator of the parking facility.

The outlay for installing markings is eliminated.

Recognition of illegal parking in no-parking zones (area-related, time-related, etc.).

DETAILED DESCRIPTION OF EXAMPLE EMBODIMENTS

Figure 1:
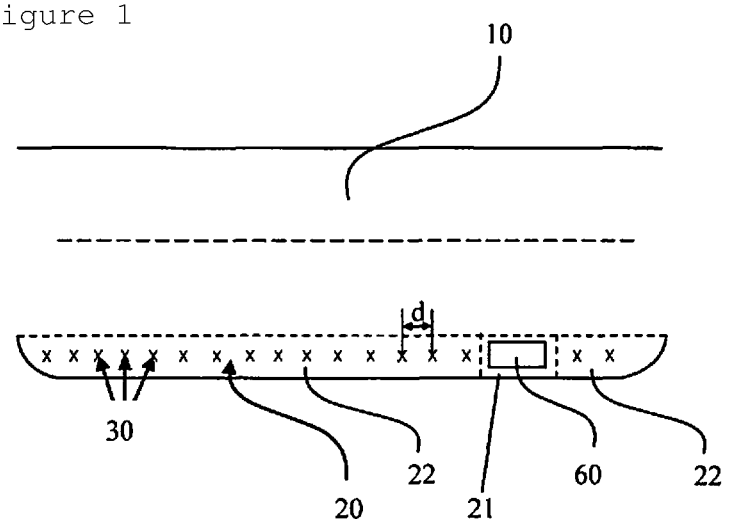
FIG. 1 schematically shows an exemplifying embodiment of a system according to the present invention.

As depicted in FIG. 1, sensors 30 are placed at specific distances d on or above area 20 to be monitored (for example by being adhesively bonded, hung, concrete-embedded, nailed, etc.).

Sensors 30 monitor a specific space around them, and can recognize whether an object, such as a car or trailer, is present in their monitored space. That measurement is communicated to a central monitoring unit 50. In the example depicted in FIG. 1, the area to be monitored is a parking bay by the side of a road 10. Occupancy sensors 30 are disposed in a row at a distance d.

Figure 2:
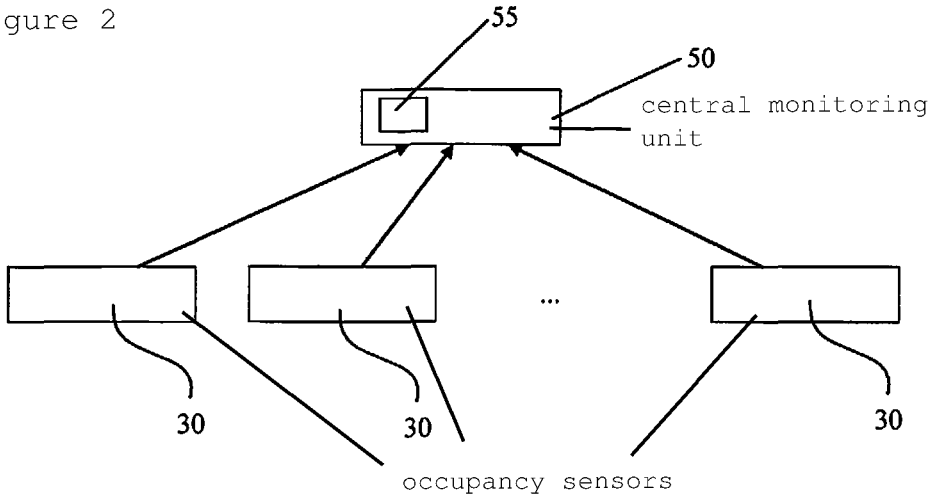
FIG. 2 schematically shows the connection of the individual sensors to the central monitoring unit (system architecture).

The system architecture is schematically depicted in FIG. 2. A plurality of occupancy sensors 30 communicate a measured occupancy status to central monitoring unit 50. Because a virtual image of area 20 is stored in a storage 55 of central monitoring unit 50, area 20 can be divided into occupied sub-areas 21 and unoccupied sub-areas 22 whose size is respectively known. It is thereby possible to determine which regions of area 20 can still be used for parking, and which areas have been occupied and for how long. This information can then be utilized further (levying charges, parking space assignment, etc.).

Figure 3:
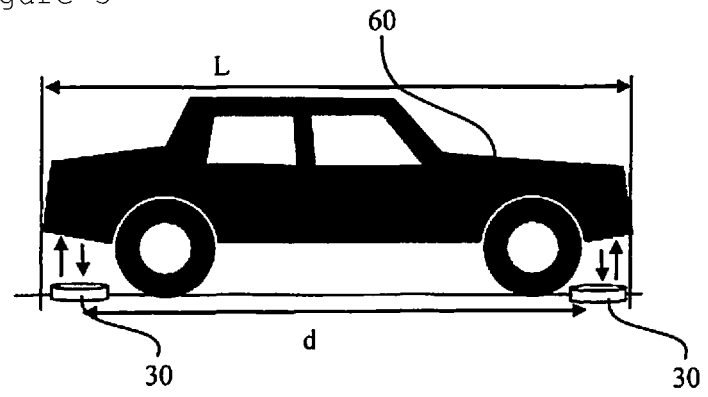
FIG. 3 is a schematic side view showing a parked vehicle as well as two occupancy sensors that detect the vehicle.
Figure 4:
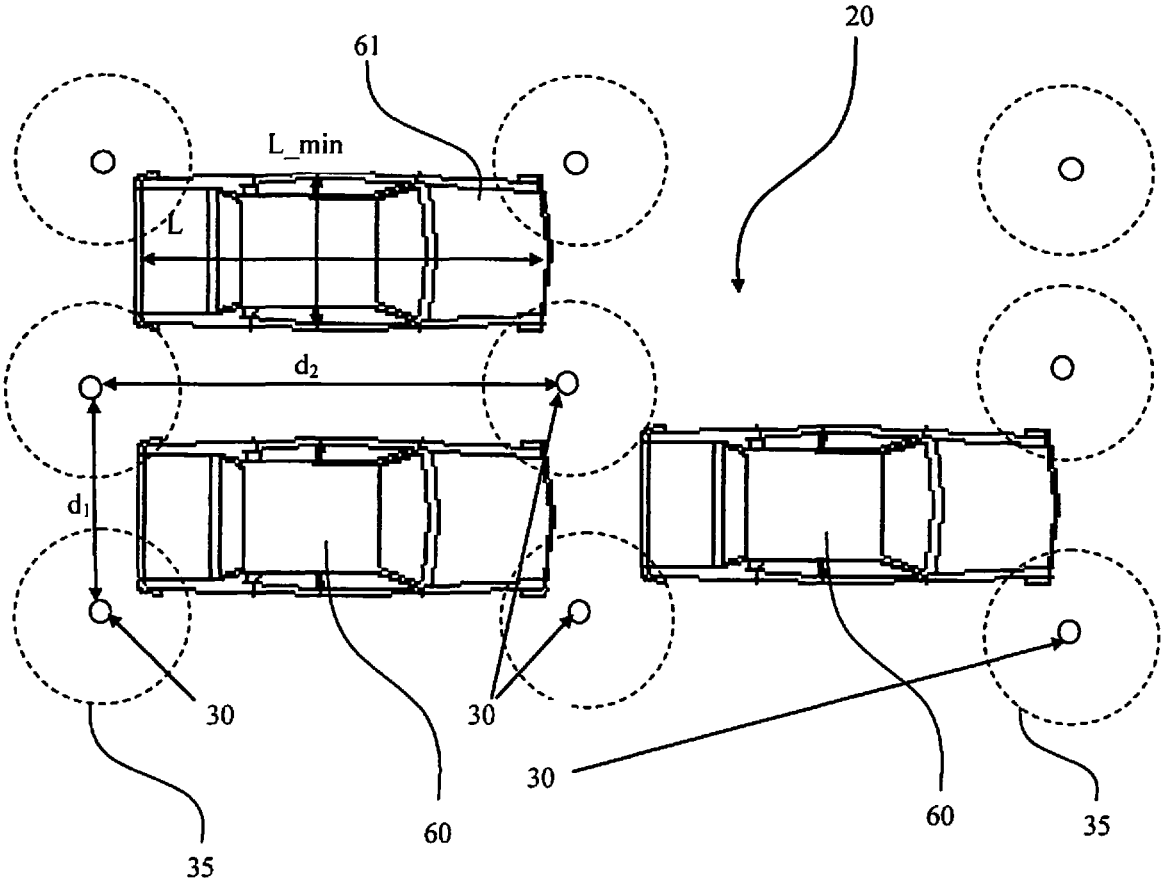
FIG. 4 is a plan view showing a parking facility having a system according to the present invention for recognizing an occupancy status.

The value of distance d between two adjacent sensors 30 is generally dependent on the type of sensor, and must be selected so that a vehicle having a minimum length L_min can be recognized. This is depicted in FIGS. 3 and 4. L_min can be selected as a function of the nature of area 20 to be monitored and of a desired minimum recognized vehicle length, L_min being the length of the shortest vehicle 61 that is to be recognized by the system (e.g., Smart car: 2.5 m; or transversely parked Smart: 1.5 m). The value d, i.e., the shortest distance between two sensors, is to be selected as a function of the type of sensor. For sensors that measure only one point directly above the sensor (e.g. ultrasonic sensor), d must be selected to be slightly smaller than L_min, as shown in FIG. 3. For sensors 30 that view a field 35 around them (e.g. magnetic field sensor), d can also be selected to be somewhat larger than L_min (see FIG. 4).

FIG. 4 furthermore depicts a two-dimensional assemblage of occupancy sensors 30 on an area 20. In this example, the distance $d_1$ between two adjacent sensors 30 in a transverse direction differs from the distance $d_2$ between two adjacent sensors in a longitudinal direction. This configuration makes it possible, in addition to a determination of the sizes of vacant and occupied sub-areas, to infer an orientation of vehicles 61, 60 that are already parked.

What is claimed is:

1. A system for recognizing an occupancy status of unmarked parking facilities, comprising:

a plurality of occupancy sensors that are disposed, at a specific distance from one another, on or above an area to be detected; and a central monitoring unit on which a virtual image of the area to be detected is stored, and which is configured to communicate with the occupancy sensors and to receive sensor data, the positions of the individual occupancy sensors being known to the central monitoring unit, and the central monitoring unit being configured to create a virtual image of the occupancy status of the area to be detected and to recognize vacant and occupied sub-areas as a function of the sensor data;

wherein a value of the specific distance between two adjacent sensors is selected so that a vehicle having a minimum length is recognizable, and wherein the value of the specific distance between the two adjacent sensors is selected as a function of a type of the sensor, so that for a sensor that measures one point directly above the sensor, the distance is selected to be smaller than the minimum length, and so that for a sensor that views a field around them, the distance is selected to be larger than the minimum length.

2. The system as recited in claim 1, wherein one of: (i) the occupancy sensors are passive sensors, the passive sensors being magnetic sensors, (ii) the occupancy sensors are as emitting sensors, the emitting sensors being one of ultrasonic sensors, radar sensors or optical sensors, or (iii) the occupancy sensors include active and passive sensor components.

3. The system as recited in claim 1, wherein the occupancy sensors are recessed into the ground of the area to be detected.

4. The system as recited in claim 1, wherein the occupancy sensors are mounted above the area to be detected on a ceiling.

5. The system as recited in claim 1, wherein the distance is selected as a function of the type of sensor, the distance being selected in such a way that a vehicle having a minimum length can be recognized by the system.

6. The system as recited in claim 5, wherein the minimum length is selected as a function of the nature of the area to be detected.

7. A method for recognizing an occupancy status of unmarked parking facilities, the method comprising:

recognizing a current occupancy status of each of a plurality of occupancy sensors of an unmarked parking facility, wherein the occupancy sensors are disposed, at a specific distance from one another, on or above an area to be detected;

storing, via a central monitoring unit, a virtual image of the area to be detected, wherein the central monitoring unit is configured to communicate with the occupancy sensors and to receive sensor data, the positions of the individual occupancy sensors being known to the central monitoring unit, and the central monitoring unit being configured to create a virtual image of the occupancy status of the area to be detected and to recognize vacant and occupied sub-areas as a function of the sensor data; and dividing the area to be detected into vacant and occupied sub-areas as a function of the occupancy statuses detected by the sensors;

wherein a value of the specific distance between two adjacent sensors is selected so that a vehicle having a minimum length is recognizable, and wherein the value of the specific distance between the two adjacent sensors is selected as a function of a type of the sensor, so that for a sensor that measures one point directly above the sensor, the distance is selected to be smaller than the minimum length, and so that for a sensor that views a field around them, the distance is selected to be larger than the minimum length.

8. A system for managing a parking area, comprising:

a system for recognizing an occupancy status of the parking area, including:

a plurality of occupancy sensors that are disposed, at a specific distance from one another, on or above an area to be detected, and a central monitoring unit on which a virtual image of the area to be detected is stored and which is embodied to communicate with the occupancy sensors and to receive sensor data, the positions of the individual occupancy sensors being known to the central monitoring unit, and the central monitoring unit being configured to create a virtual image of the occupancy status of the area to be detected and to recognize vacant and occupied sub-areas as a function of the sensor data; and a management unit to assign a vacant sub-area to an arriving vehicle as a parking space, the vacant sub-area being assigned as a function of a vehicle length;

wherein a value of the specific distance between two adjacent sensors is selected so that a vehicle having a minimum length is recognizable, and wherein the value of the specific distance between the two adjacent sensors is selected as a function of a type of the sensor, so that for a sensor that measures one point directly above the sensor, the distance is selected to be smaller than the minimum length, and so that for a sensor that views a field around them, the distance is selected to be larger than the minimum length.

* * * * *